US010457529B2

(12) United States Patent
Schoonmaker

(10) Patent No.: US 10,457,529 B2
(45) Date of Patent: Oct. 29, 2019

(54) CRANE WITH ROTARY LOCKING MECHANISM

(71) Applicant: Manitowoc Crane Companies, LLC, Manitowoc, WI (US)

(72) Inventor: Stephen J. Schoonmaker, Chambersburg, PA (US)

(73) Assignee: Manitowoc Crane Companies, LLC, Manitowoc, WI (US)

( * ) Notice: Subject to any disclaimer, the term of this patent is extended or adjusted under 35 U.S.C. 154(b) by 170 days.

(21) Appl. No.: 15/496,350

(22) Filed: Apr. 25, 2017

(65) Prior Publication Data

US 2017/0305727 A1 Oct. 26, 2017

Related U.S. Application Data

(60) Provisional application No. 62/326,960, filed on Apr. 25, 2016.

(51) Int. Cl.
*B66C 23/70* (2006.01)
*B66C 23/42* (2006.01)

(52) U.S. Cl.
CPC ..... *B66C 23/708* (2013.01); *B66C 23/42* (2013.01); *B66C 23/705* (2013.01)

(58) Field of Classification Search
CPC ..... B66C 23/708; B66C 23/705; B66C 23/42
See application file for complete search history.

(56) References Cited

U.S. PATENT DOCUMENTS 4,036,372 A * 7/1977 Rao ..... B66C 23/705 212/230
4,327,533 A * 5/1982 Sterner ..... B66C 23/708 212/292
4,688,689 A * 8/1987 Barsuhn ..... B66C 23/708 212/264
5,261,640 A * 11/1993 Yuan ..... B66C 23/48 254/8 B
5,628,416 A * 5/1997 Frommelt ..... B66C 23/705 212/292
6,216,895 B1 * 4/2001 Erdmann ..... B66C 23/708 212/292
6,527,131 B1 * 3/2003 Brockelmann ..... B66C 23/705 212/292
9,090,438 B2 * 7/2015 Krebs ..... B66C 23/708
(Continued)

FOREIGN PATENT DOCUMENTS

CN 101537979 A 9/2009
CN 101804945 A 8/2010
(Continued)

OTHER PUBLICATIONS

International Preliminary Report on Patentability (IPRP) issued by the International Bureau in connection with corresponding International Application PCT/US2017/029149, dated Nov. 8, 2018.
(Continued)

*Primary Examiner* — Michael E Gallion
(74) *Attorney, Agent, or Firm* — Levenfeld Pearlstein, LLC

(57) ABSTRACT

A telescoping crane boom having a rotary locking mechanism. A motor drives a rotating element about an axis parallel to the axis of the crane boom. The rotation of the rotating member causes a pin to selectively lock and unlock sections of the telescoping crane boom.

11 Claims, 8 Drawing Sheets

(56) References Cited

U.S. PATENT DOCUMENTS

| | | | | |
|---|---|---|---|---|
| 2001/0052506 | A1* | 12/2001 | Richter | B66C 23/705 212/177 |
| 2002/0056693 | A1* | 5/2002 | Stowasser | B66C 23/705 212/292 |
| 2010/0187194 | A1 | 7/2010 | Schuermann et al. | |

FOREIGN PATENT DOCUMENTS

| | | | |
|---|---|---|---|
| DE | 29713297 | U1 | 3/1998 |
| DE | 10223449 | A1 | 12/2003 |
| DE | 202004017598 | U1 | 3/2006 |
| EP | 2392537 | A1 | 12/2011 |
| FR | 2797862 | A1 | 3/2001 |

OTHER PUBLICATIONS

International Search Report issued by ISA/EPO in connection with PCT/US2017/029149 dated Jul. 20, 2017.
Written Opinion of the ISA issued by ISA/EPO in connection with PCT/US2017/029149 dated Jul. 20, 2017.

* cited by examiner

CRANE WITH ROTARY LOCKING MECHANISM

RELATED APPLICATIONS

The present patent document claims the benefit of the filing date under 35 U.S.C. § 119(e) of Provisional U.S. Patent Application Ser. No. 62/326,960, filed Apr. 25, 2016, which is hereby incorporated by reference.

BACKGROUND

1. Technical Field Text

Embodiments are directed to the general field of mobile cranes and more particularly to telescoping members such as booms.

2. Background Information

FIG. 1 illustrates a crane 10 having a chassis 11 and upper works 13. Because the crane 10 is mobile and may be moved while on site, and is also transported from site to site, the crane 10 is sized to travel over the road and for transport on commonly available transport systems. Due to size constraints, the crane 10 includes extendable components to allow the crane 10 to increase in dimension while at the job site. For example, in FIG. 1, the crane 10 has a telescoping boom 12. The minimum length of the boom 12 must be short enough for safe highway travel, as well as travel around a job site. However, a lift job typically requires a much longer boom 12. To allow for a longer boom 12, the crane 10 has multiple boom segments that the nest within one another.

While the general concept of a telescoping boom 12 is fairly straightforward, its actual implementation is complex. In order to achieve a maximum length, a telescoping boom 12 typically has multiple sections, with each section nesting in an adjacent section. FIG. 2 illustrates an enlarged view of the tip of the boom 12 of the crane 10 of FIG. 1. This boom 12 has a base section 16, three intermediate sections 18, 20, 22, and an inner section 24. These sections each extend and retract depending on the necessary length of the boom 12. Furthermore, a single drive system, such as an inverted hydraulic actuator, is used to move the sections 18, 20, 22, 24 in and out of the base section 16. The use of a single drive avoids the excess weight that would result from the use of multiple drive systems. Once a section is extended from the base section 16, it is locked to the section it is nested within.

FIG. 3 illustrates a schematic of a drive system for extending a boom in the form of an inverted hydraulic actuator 26. The inverted hydraulic actuator 26 is located within the base section 16 with a rod 28 connected to the base section 16 and a cylinder 30 that is free to move relative to the base section 16 when the inverted hydraulic actuator 26 is actuated. A pinning head 32 is disposed at a rod end of the cylinder 30 and has a cylinder-to-boom section pin 34 for pinning the pinning head 32 to a boom section and a boom section connection pin actuator 36 for actuating a pin to lock adjacent boom sections together once extended.

In operation, the pinning head 32 actuates the boom section pin 34 to pin the inner boom section 24 to the cylinder 30. The cylinder 30 is actuated, moving the inner section 24 out of the base section 16. Once the inner section 24 is extended to a desired distance, the inner section 24 is pinned to the next boom section 22 with the boom section connection pin actuator 36. The cylinder to boom section pin 34 is then released from the inner boom section 24 and the cylinder 30 is retracted. Once retracted, the pinning head 32 is pinned to the next section 22 with the cylinder-to-boom section actuator 34. The next section 22 extends from the base section 16, pushing the inner section 24, which is now pinned to the next section 22, out farther as well. Once extended, section 22 is pinned to section 20 with the boom section connection pin actuator 36 to lock the sections together. The cylinder-to-boom section pin actuator 34 is released and the cylinder 30 is retracted. This process continues, extending boom sections until the desired boom length is achieved.

The pinning head 32 is responsible for at least two pinning operations. The first is actuating the boom section connection pin 36 to couple the boom sections together. This is done with a small hydraulic actuator 37 mounted parallel to the inverted hydraulic actuator 26 as shown in FIG. 3. The second pinning operation actuates a pin laterally, perpendicular to the direction of travel of the boom sections; this pinning operation is performed with hydraulic pressure exposed to surfaces of the pin internal to the pinning head 32. However, this pin translation is perpendicular to the main actuator.

To simplify the design, each of the hydraulic actuators operates using the same hydraulic source as the main inverted hydraulic actuator 26. The pressurized hydraulic fluid is controlled by a control valve 38 which selectively pressurizes the boom section connection pin actuator 36 or the cylinder to boom section pin actuator 34. Because the control valve 38 and the and pin actuators 34, 36 move with the telescoping cylinder 30, the hydraulic line 40 needs to adjust to compensate for the varying distance between the hydraulic pressure source and the actuators 34, 36. This may be accomplished through a trombone tube which extends in length when the telescoping cylinder 30 is extended. However, because the tube's internal volume changes as the cylinder 30 is retracted and extended, the speed at which the cylinder 30 is retracted and extended is limited to avoid excessive pressure changes in the trombone tube.

Current pinning systems such as that shown in FIG. 3 suffer from further shortcomings such as being a dead end system. It is very difficult to bleed air from the system since there is no return flow from the pinning actuators 34, 36. The control system is also very complicated for a hydraulic system, requiring the cylinder 30 to be actuated across large distances (such as 10 meters) while extending boom sections, and then precisely positioned to within 5 mm of a pinning hole for pinning the cylinder 30 to a section. To improve validation of cylinder 30 positioning, current systems may use proximity switches within the pinning head 32 (which are in a virtually unmaintainable location), and proximity switches with the pinning head components near the boom section weldment. This requires a large amount of control system complexity and precision assembly procedures.

Finally, in addition to complexity to position cylinder 30 to a boom section, there is no use of a positive identification of the boom section being approached or connected to. Thus, the system must keep track of where the cylinder 30 is and which boom sections it has connected in the past. Furthermore, this logic must be kept in non-volatile memory so that after a power cycle, the control system still knows where the sections were from the previous use.

What is needed is a telescoping boom that addresses the shortcomings in current boom design. It would be beneficial if the system was simpler than existing systems while allowing the boom to extend and retract rapidly independent of the lock actuators.

BRIEF DESCRIPTION

In one aspect of the description, a telescoping boom is disclosed. The telescoping boom includes a base section, a first telescoping boom section, a linear actuator, a rotary element, and a rotary actuator. The base section has a base end and a telescoping end. The first telescoping boom section is disposed within the main boom section and has a pin receiver configured to receive a pin. The linear actuator is disposed within the main boom section and has a stationary portion and an actuated portion. The actuated portion is configured to extend and retract longitudinally relative to the base section. The rotary element is coupled to the actuated portion and has an axis of rotation parallel to a longitudinal axis of the main boom section and a pin perpendicular to the axis of rotation. In a first configuration the pin engages the first telescoping boom section and in a second configuration radially offset from the first configuration the pin does not engage the first telescoping section. The rotary actuator is coupled to the main boom section and the rotary element and is configured to rotate the rotary element relative to the main boom section.

In some embodiments, the pin receiver has a ramped engagement in a longitudinal direction. In some embodiments, the first configuration extends the pin laterally and the second configuration retracts the pin laterally. In some embodiments, the first configuration is offset angularly from the second configuration.

In some embodiments, the boom further includes a plurality of proximity sensors disposed in the main boom section and the plurality of proximity sensors are configured to identify a boom section.

In some embodiments, the telescoping boom includes a second telescoping boom section disposed within the first telescoping boom section and the second telescoping boom section has a second receiver configured to receive the pin.

In another aspect a crane is disclosed. The crane includes a chassis and an upper works coupled to the chassis. The upper works includes the telescoping boom described previously.

In some embodiments, the pin receiver has a ramped engagement in a longitudinal direction. In some embodiments, the first configuration extends the pin laterally and the second configuration retracts the pin laterally. In some embodiments, the first configuration is offset angularly from the second configuration.

In some embodiments, the boom of the crane further includes a plurality of proximity sensors disposed in the main boom section and the plurality of proximity sensors configured to identify a boom section. In some embodiments, the boom further includes a second telescoping boom section disposed within the first telescoping boom section, the second telescoping boom section having a second receiver configured to receive the pin.

In another aspect, a rotary locking mechanism for a crane boom is disclosed. The rotary locking mechanism includes a rotating element, a motor, and at least one pin. The motor has a bearing surface configured to interact with an inverted hydraulic cylinder. The motor is configured to drive the rotating element about an axis of rotation. The at least one pin has a first configuration corresponding to the rotating element being in a first angular orientation and a second configuration corresponding to the rotating element being in a second angular orientation.

In some embodiments, a body of the motor is fixed relative to the bearing surface of the rotating element. In some embodiments, a body of the motor is fixed relative to the at least one pin. In some embodiments, the at least one pin is configured to rotate from the first configuration to the second configuration. In some embodiments, the at least one pin is configured to move laterally from the first configuration to the second configuration.

DETAILED DESCRIPTION

The present embodiments will now be further described. In the following passages, different aspects of the embodiments are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

Figure 1:
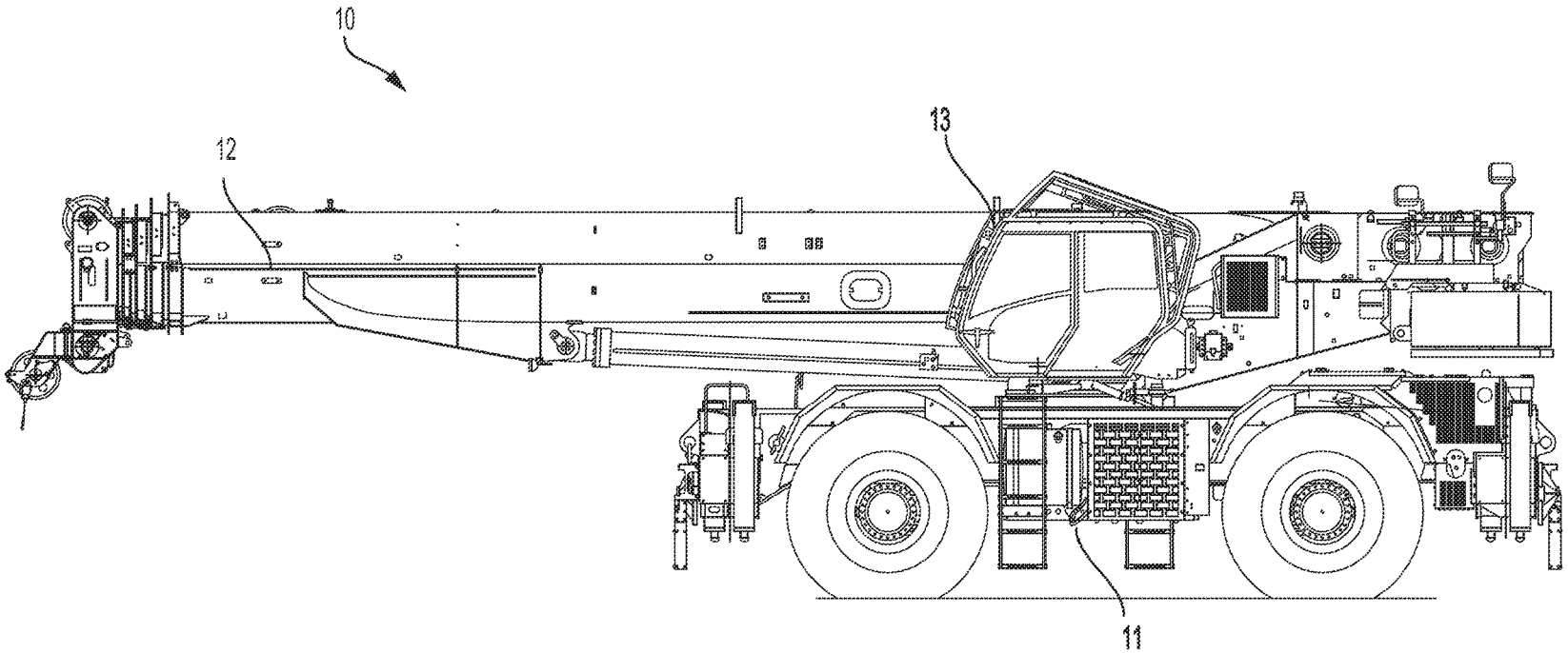
FIG. 1 illustrates an overview of an existing mobile crane.
Figure 2:
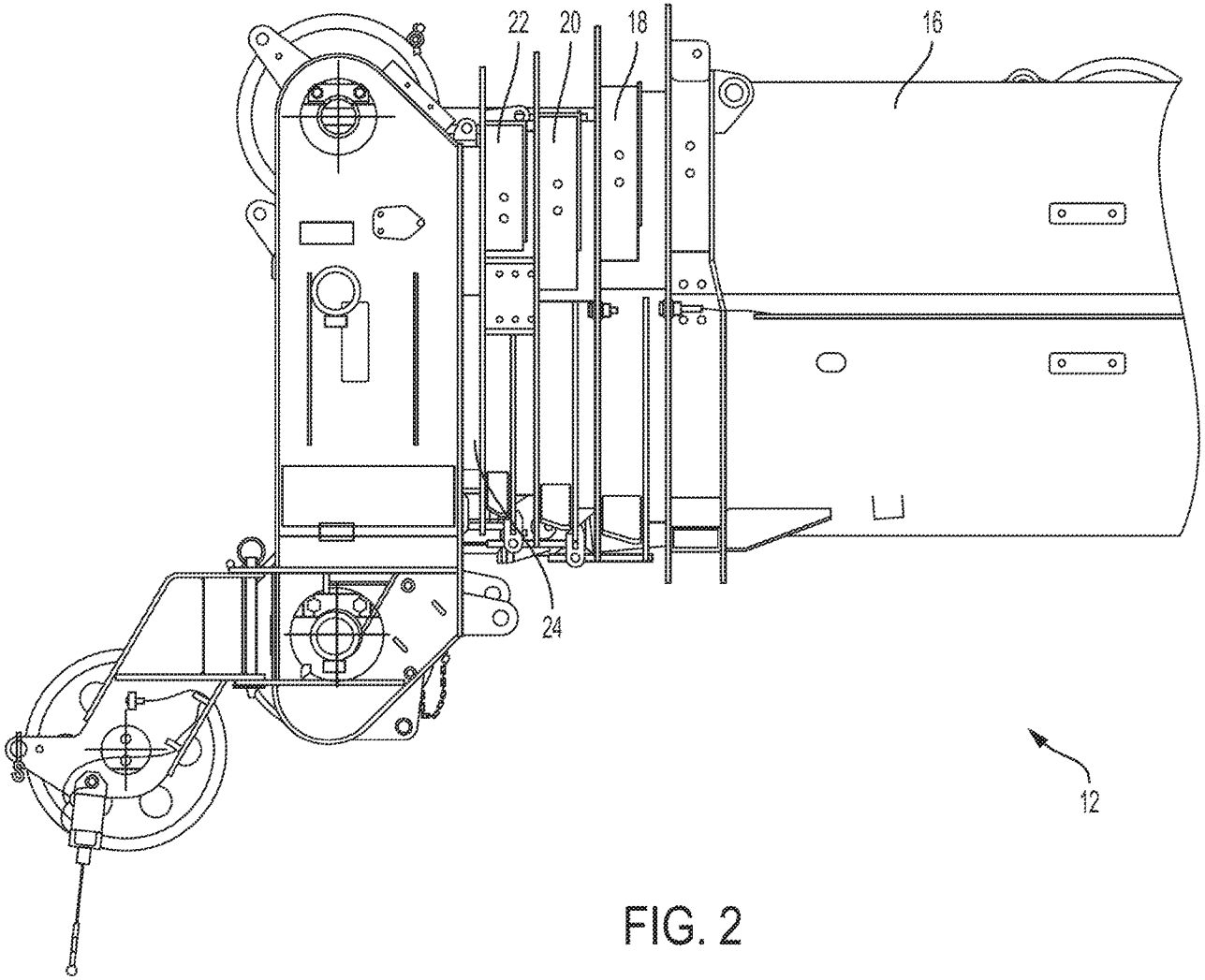
FIG. 2 illustrates a detailed view of the tip of a boom of a mobile crane showing the nested boom sections.
Figure 3:
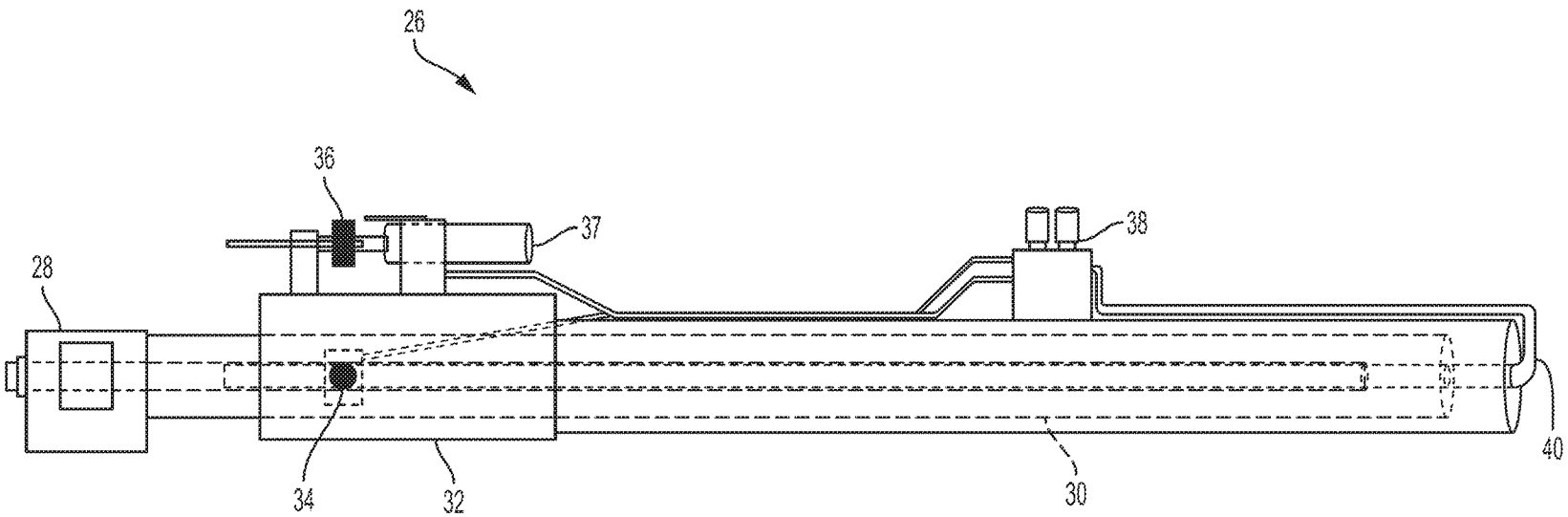
FIG. 3 illustrates a schematic of an actuator.
Figure 4:
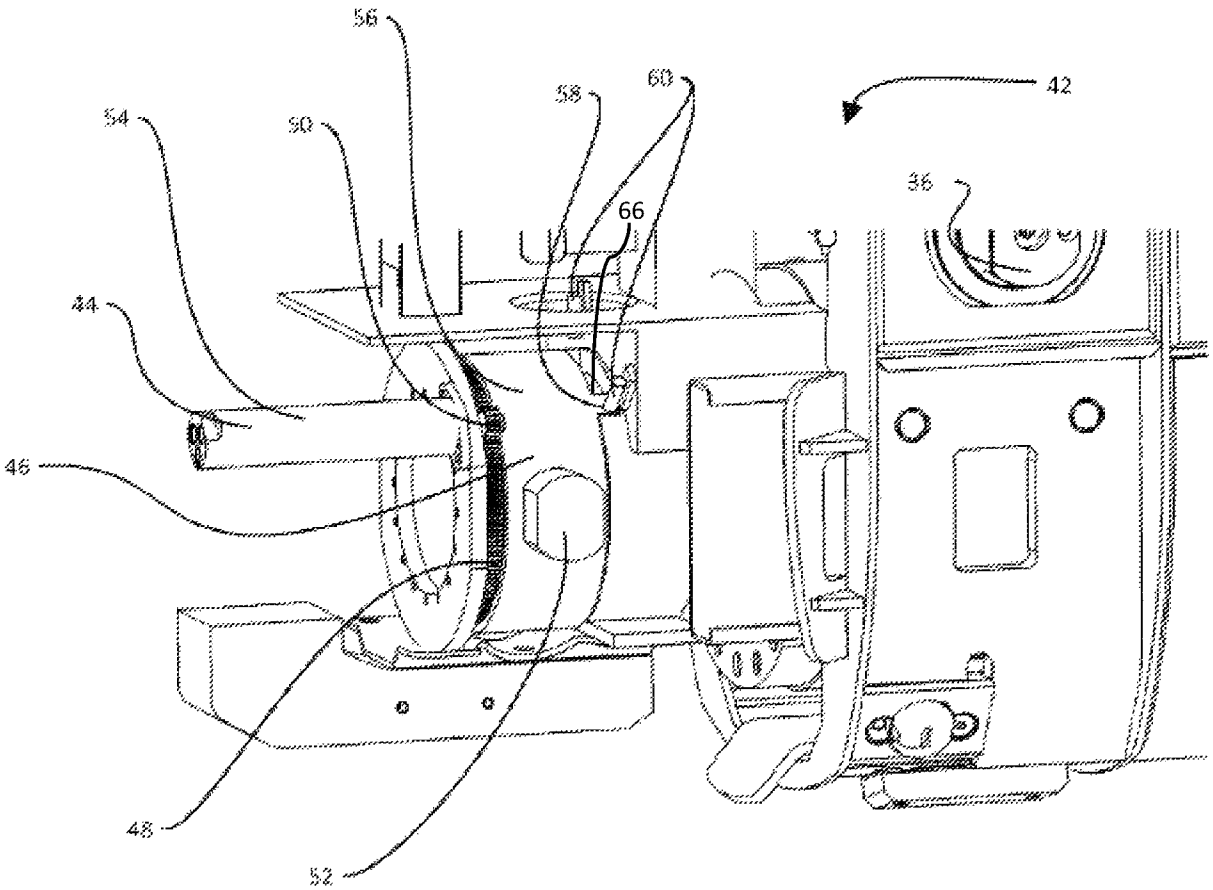
FIG. 4 illustrates an embodiment of a rotary locking mechanism.

FIG. 4 illustrates an embodiment of a rotating locking mechanism 42 for coupling an inverted hydraulic actuator 26 to a telescoping boom section. For simplicity, the rotating locking mechanism 42 is shown without the base boom section 16, the telescoping boom sections 18, 20, 22, 24, and the rod 28 of the inverted hydraulic actuator 26. In operation, the rotating locking mechanism 42 would be disposed internal to the base main boom section 16 with the rod 28 of the inverted hydraulic actuator 26 extending through the rotating locking mechanism 42.

The rotating locking mechanism 42 includes a motor 44 for providing a rotary motion and a rotating element 46. The motor 44 may be an electrical motor, a pneumatic motor, or a hydraulic motor. In conventional booms, electrical power may already be provided by way of a cable reel mechanism that is a part of the conventional pinned boom design (for electrical power for solenoids in valves and electrical communications). Similarly, pneumatic power might also be provided by a reel. Pneumatic power is advantageous in that it is able to store energy over a period of time (building pressure), and then being released in a sudden demand for power.

In FIG. 4, the conventional pinning head 32, has been removed and replaced with the rotating locking mechanism 42. The motor 44 is rigidly mounted to the inverted hydraulic actuator 26 to prevent its body 54 from rotating relative to the inverted hydraulic actuator 26. The driveshaft of the motor drives the rotating element 46 through a circular rack 48 and pinion 50 gear combination. Other techniques for transmitting torque between the motor 44 and the rotating element 46 are contemplated such as a chain drive, pulley system, or compound gears. In some embodiments, it is possible to reverse the elements, such that the motor 44 is mounted to the rotating element 46 and rotates with the element while the circular rack 48 remains stationary.

The rotating element 46 has a cylinder-to-section pin 52 that extends from an outer surface 56 of the rotating element 46. The rotating element 46 may have protrusions 58 on the outer surface 56 of the rotating element that interact with proximity switches 60 on a non-rotating portion of the rotating locking mechanism 42 to detect the relative position of the rotating element 46. The proximity switches 60 may be used to determine the two extents of the rotating element 46. The rotating element 46 may have a bearing surface 66 such as a roller bearing for the interface between the rotating element 46 and the inverted hydraulic actuator 26. Other embodiments may use a journal bearing or a thrust bearing between the rotating element 46 and the inverted hydraulic actuator 26.

The cylinder-to-boom section pin 52 transmits an axial force from the inverted hydraulic actuator 26 to a telescoping boom section through the rotating mechanism 46 to extend the boom 12. In some embodiments, there is no de-rating for the inverted hydraulic actuator 26 as the boom 12 is extended or retracted, such that the interface between the telescoping boom section and the inverted hydraulic actuator 26 transmits the full load of the boom 12 during telescoping operations.

Figure 5:
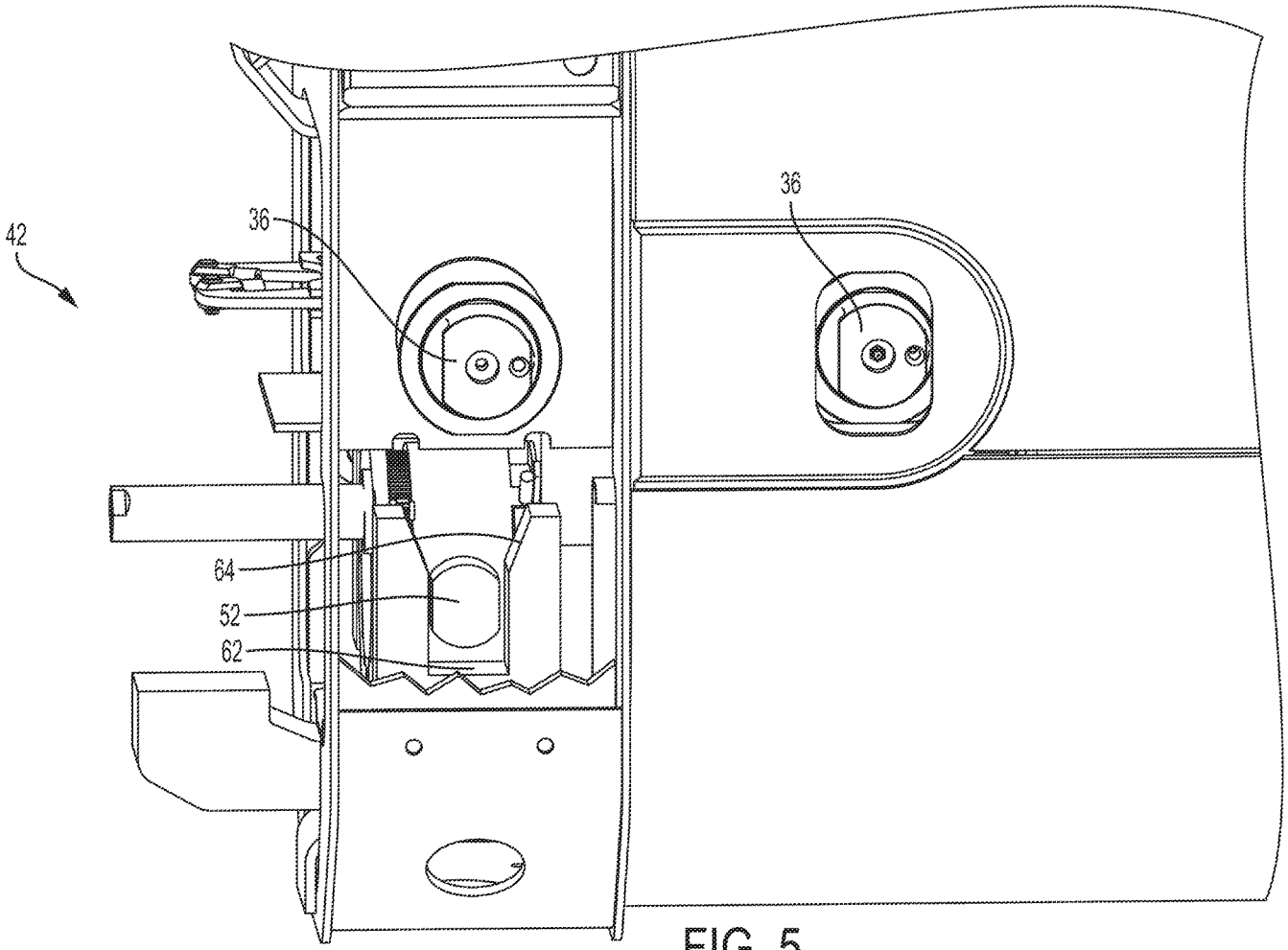
FIG. 5 illustrates the embodiment of FIG. 4 with the pin in a locked position.

FIG. 5 illustrates the rotating locking mechanism 42 of FIG. 4 along with a partial view of a telescoping boom section. In this view, the rotating locking mechanism 42 is shown engaged in a locked position with the cylinder-to-section pin 52 engaged with a the telescoping boom section. The telescoping boom section has a recess 62 that receives the cylinder-to-boom section pin 52. The recess 62 has a ramped engagement region 64 that guides the cylinder-to-boom section pin 52 into position. The rotating locking mechanism 42 is able to pin the inverted hydraulic actuator 26 to the telescoping boom section if the cylinder-to-boom section pin 52 encounters the recess 62 at either the ramped engagement region 64, or the recess 62 itself. In some embodiments, if the cylinder-to-boom section pin 52 encounters the ramped engagement region 64, the cylinder-to-boom section pin may push either the inverted hydraulic actuator 26 or the telescoping boom section axially to align the cylinder-to-boom pin and the recess.

In operation, once the rotating locking mechanism is in the general location of engagement, the motor 44 may attempt to rotate the rotating element 46 and consequently the cylinder-to-boom section pin 52 into the engagement with the recess 62. If the cylinder-to-boom section pin 52 and the recess 62 are not aligned, the inverted hydraulic actuator 26 may be extended or retracted to assist engagement. In embodiments using a pneumatic drive, the motor 22 may be powered even if the cylinder-to-boom section pin 52 is not in position to engage the recess 62. Then, once the cylinder-to-boom section pin 52 encounters the recess 62 as the inverted hydraulic actuator 26 is moved axially, the air motor would move the cylinder-to-boom section pin 52 pin into the recess 62.

In some embodiments, the motor 44 may have a rotational encoder to indicate which telescoping boom section the cylinder-to-boom section pin 52 is engaging with. For example, each telescoping boom section may have a different angular orientation of the recess 62 such that a bottom of each recess 62 has different angular orientation. By measuring the angular orientation at which the cylinder-to-boom section pin 52 encounters the bottom of the recess 62, it is possible to identify the telescoping boom section being actuated.

In some embodiments, rather than position the rotating locking mechanism 42 at the recess 62 and then rotating the cylinder-to-boom section pin 52 into engagement with the recess 62, the rotating locking mechanism 42 may be positioned to a known position offset from the recess 62. The motor 44 may then be powered at the same time as the inverted hydraulic actuator 26. As the recess 62 comes into position, the rotatory locking mechanism moves the cylinder-to-boom section pin 52 into the locked position.

Figure 6:
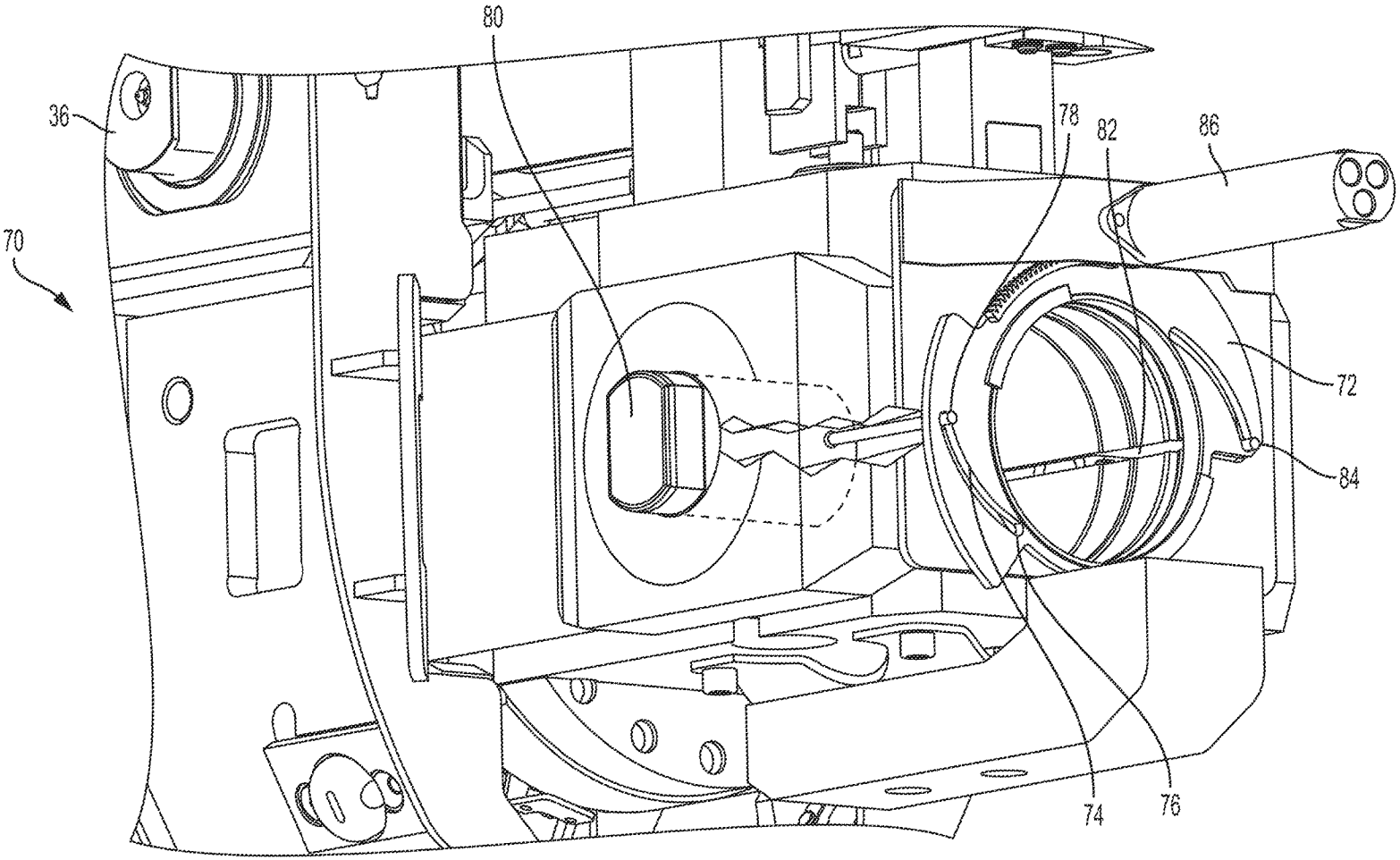
FIG. 6 illustrates an embodiment of a rotary locking mechanism.
Figure 7:
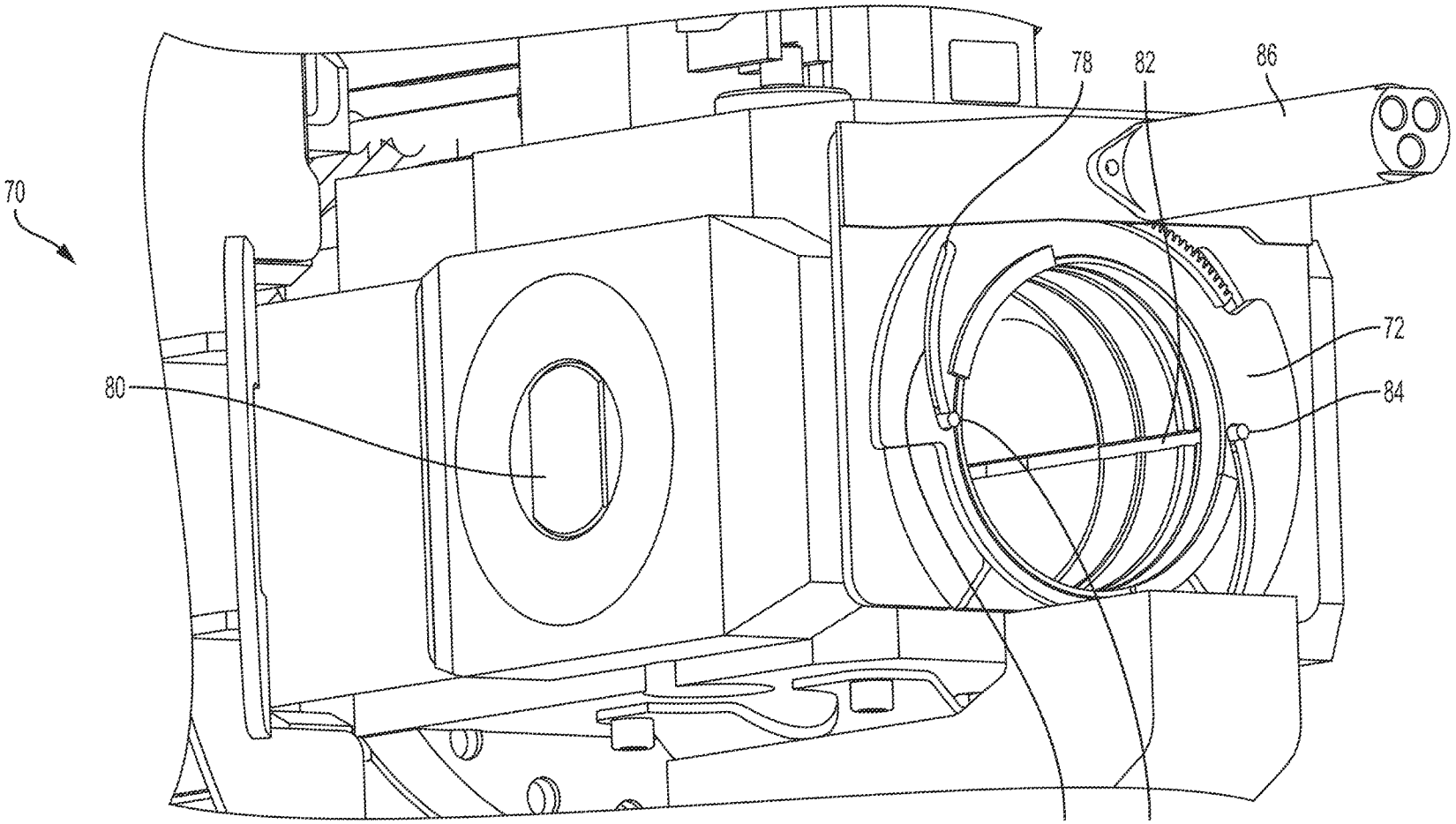
FIG. 7 illustrates the embodiment of FIG. 6 with a retracted pin.

FIG. 6 illustrates another embodiment of a rotary locking mechanism 70. In this embodiment, a rotating element 72 has at least one slot 74 having a first end 76 towards the axis of rotation of the rotating element 72 and a second end 78 positioned away from the axis of rotation. A cylinder-to-boom section pin 80 is disposed on a side of the rotary locking mechanism 70 and is able to move laterally to engage and disengage telescoping boom sections. The rotary locking mechanism 70 has a recess 82 parallel to the axis of the inverted hydraulic actuator 26 that aligns with the cylinder-to-boom section pin 80 and the slot 74 in the rotating element 72. A pin actuator 84 resides in the recess 82 and connects the cylinder-to-boom section pin 80 to the slot 74 of the rotating element 72. When the motor 86 is powered, it causes the rotating element 72 to turn and the slot 74 forces the pin actuator 84 to move laterally, as shown in FIG. 7. The lateral movement of the pin actuator 84 causes the cylinder-to-boom section pin 80 to move laterally, locking boom sections to the inverted hydraulic actuator 26.

In some embodiments, it may be beneficial to improve the system for aligning the inverted hydraulic actuator 26 with the telescoping boom sections. It would be beneficial for the new system to indicate general alignment and identify which boom section has been approached. This information is valuable for the control system and removes some of the need to store a history of which operations have been performed to determine the current state of the boom.

Figure 8:
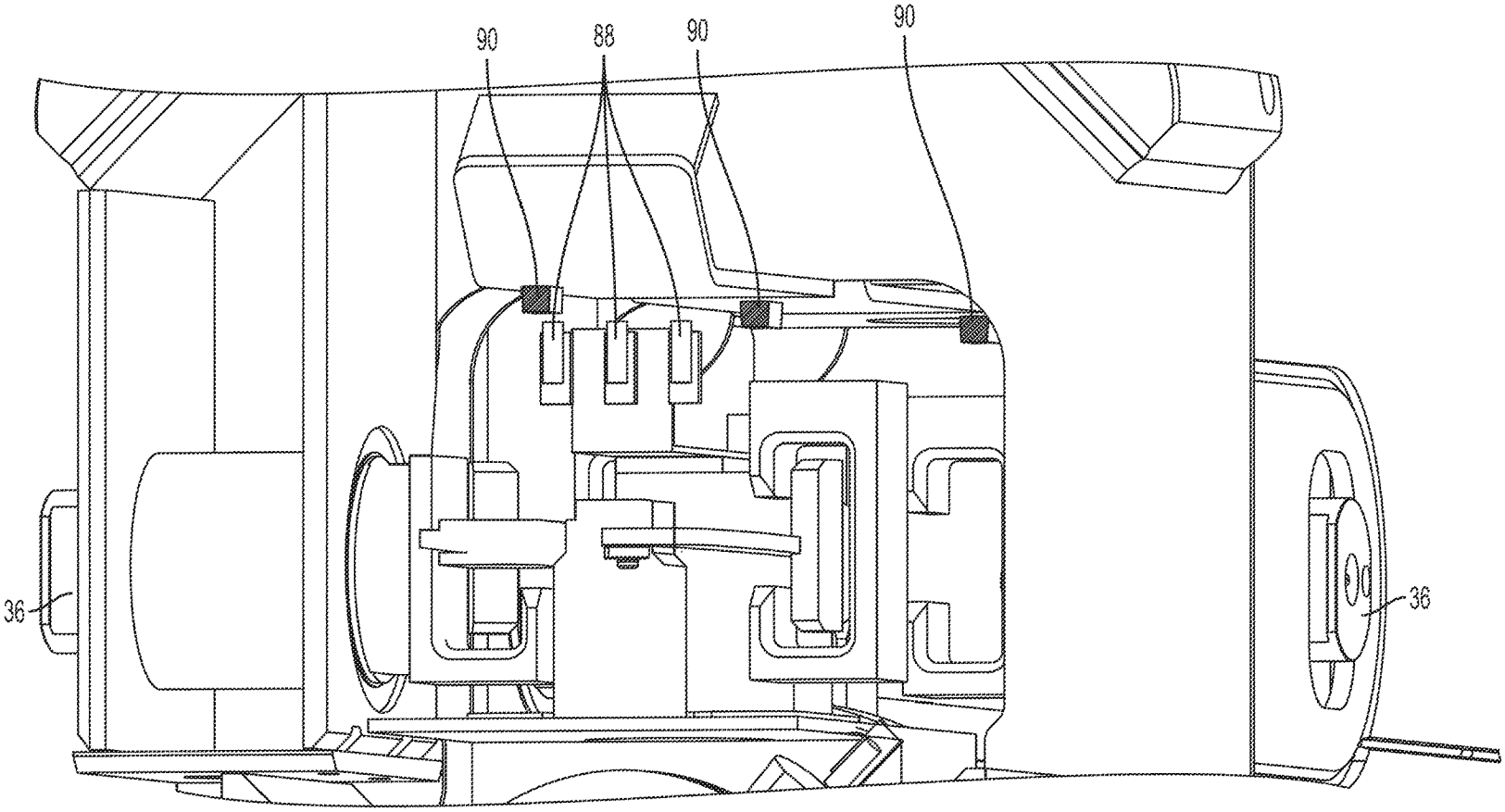
FIG. 8 illustrates a system of proximity switches for determining a boom segment.

FIG. 8 illustrates an embodiment of a rotary locking mechanism 42 having a positive boom section identification system. The rotating locking mechanism 42 includes an array of proximity switches 88 and the boom sections include section identifying targets 90. The section identification targets 90 are offset laterally and allow unique identification of the boom sections. A pattern of three proximity switches 88 and corresponding targets 90 can uniquely identify up to seven boom sections (patterns such as 0-0-1, 0-1-0, 0-1-1, 1-0-0, 1-0-1, 1-1-0, and 1-1-1). The identification targets 90 can also perform a dual function in indicating both the boom section, and the engagement area for the rotary locking mechanism 42 to actuate the cylinder-to-boom section pin.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention claimed is:

1. A telescoping boom, comprising:

a base section having a base end and a telescoping end;

a first telescoping section disposed within the base section, the first telescoping section having a recess configured to receive a cylinder-to-section pin;

an inverted hydraulic actuator disposed within the base section, the inverted hydraulic actuator having a rod and a cylinder configured to extend and retract longitudinally relative to the base section;

a rotating element coupled to the cylinder, the rotating element having an axis of rotation parallel to a longitudinal axis of the base section and the cylinder-to-section pin perpendicular to the axis of rotation, the rotating element having a first configuration in which the cylinder-to-section pin engages the first telescoping section and a second configuration angularly offset from the first configuration in which the cylinder-to-section pin does not engage the first telescoping section; and a motor coupled to the base section and the rotating element, the motor configured to rotate the rotating element and the cylinder-to-section pin relative to the base section.

2. The telescoping boom of claim 1, wherein the recess has a ramped engagement in a longitudinal direction.

3. The telescoping boom of claim 1, further comprising a plurality of proximity sensors disposed in the base section, the plurality of proximity sensors configured to identify a boom section.

4. The telescoping boom of claim 1, further comprising a second telescoping section disposed within the first telescoping section.

5. A crane comprising:

a chassis;

an upper works coupled to the chassis, the upper works comprising the telescoping boom of claim 1.

6. The crane of claim 5, wherein the recess has a ramped engagement in a longitudinal direction.

7. The crane of claim 5, wherein the telescoping boom further comprises a plurality of proximity sensors disposed in the base section, the plurality of proximity sensors configured to identify a boom section.

8. The crane of claim 5, wherein the telescoping boom further comprises a second telescoping boom section disposed within the first telescoping boom section.

9. A rotary locking mechanism for a crane boom, comprising:

a rotating element having a bearing surface configured to interact with an inverted hydraulic cylinder;

a motor configured to drive the rotating element about an axis of rotation; and at least one cylinder-to-section pin having a first configuration corresponding to the rotating element being in a first angular orientation and a second configuration corresponding to the rotating element being in a second angular orientation wherein the at least one cylinder-to-section pin is configured to rotate from the first configuration to the second configuration.

10. The rotary locking mechanism of claim 9, wherein a body of the motor is fixed relative to the bearing surface of the rotating element.

11. The rotary locking mechanism of claim 9, wherein a body of the motor is fixed relative to the at least one cylinder-to-section pin.

* * * * *